US005628659A

United States Patent [19]

Xie et al.

[11] Patent Number: 5,628,659

[45] Date of Patent: May 13, 1997

[54] METHOD OF MAKING A FIELD EMISSION ELECTRON SOURCE WITH RANDOM MICRO-TIP STRUCTURES

[75] Inventors: Chenggang Xie, Cedar Park; Nalin Kumar, Canyon Lake; Howard K. Schmidt, Houston, all of Tex.

[73] Assignees: Microelectronics and Computer Corporation; SI Diamond Technology, Incorporated, both of Austin, Tex.

[21] Appl. No.: 427,464

[22] Filed: Apr. 24, 1995

[51] Int. Cl.[6] ..... H01J 1/30; H01J 9/42; H01J 9/02

[52] U.S. Cl. ..... 445/3; 445/50; 445/60; 204/192.11; 204/192.34; 204/298.04; 204/298.36

[58] Field of Search ..... 445/50, 3, 60; 204/192.11, 192.34, 298.04, 298.36

[56] References Cited

U.S. PATENT DOCUMENTS

| | | |
|---|---|---|
| 3,259,782 | 7/1966 | Shroff . |
| 3,665,241 | 5/1972 | Spindt et al. . |
| 3,755,704 | 8/1973 | Spindt et al. . |
| 3,789,471 | 2/1974 | Spindt et al. . |
| 3,812,559 | 5/1974 | Spindt et al. . |
| 3,855,499 | 12/1974 | Yamada et al. . |
| 3,947,716 | 3/1976 | Fraser, Jr. et al. . |
| 3,970,887 | 7/1976 | Smith et al. . |
| 4,008,412 | 2/1977 | Yuito et al. . |
| 4,075,535 | 2/1978 | Genequand et al. . |
| 4,084,942 | 4/1978 | Villalobos . |
| 4,139,773 | 2/1979 | Swanson . |
| 4,141,405 | 2/1979 | Spindt . |
| 4,143,292 | 3/1979 | Hosoki et al. . |
| 4,164,680 | 8/1979 | Villalobos . |
| 4,168,213 | 9/1979 | Hoeberechts . |
| 4,307,507 | 12/1981 | Gray et al. . |
| 4,350,926 | 9/1982 | Shelton . |
| 4,498,952 | 2/1985 | Christensen . |
| 4,513,308 | 4/1985 | Greene et al. . |
| 4,540,983 | 9/1985 | Morimoto et al. . |
| 4,578,614 | 3/1986 | Gray et al. . |
| 4,588,921 | 5/1986 | Tischer . |
| 4,594,527 | 6/1986 | Genevese . |
| 4,663,559 | 5/1987 | Christensen . |
| 4,685,996 | 8/1987 | Busta et al. . |

(List continued on next page.)

FOREIGN PATENT DOCUMENTS 88 07288 12/1989 France .

OTHER PUBLICATIONS

S.M. Rossnagel et al., *J. Vac. Sci. Tecnol.*, 20(2), Feb. 1982, 195–8.

S. Yamanaka et al., *Japan J. Appl. Phys.*, 16(7), 1977, 1245–6.

A.P. Janssen et al., *J. Phys. D: Appl. Phys.*, 4(1), 1971, 118–23.

"Cone Formation as a Result of Whisker Growth on Ion Bombarded Metal Surfaces," *J. Vac. Sci. Technol.* A 3(4), Jul./Aug. 1985, pp. 1821–1834.

"Cone Formation on Metal Targets During Sputtering," *J. Appl. Physics*, vol. 42, No. 3, Mar. 1, 1971, pp. 1145–1149.

"Control of Silicon Field Emitter Shaper with Isotrophically Etched Oxide Masks," Dec. 1989.

(List continued on next page.)

*Primary Examiner*—P. Austin Bradley
*Assistant Examiner*—Jeffrey T. Knapp
*Attorney, Agent, or Firm*—Kelly K. Kordzik; Winstead Sechrest & Minick P.C.

[57] ABSTRACT

A system and method is available for fabricating a field emitter device, where in an emitter material, such as copper, is deposited over a resistive layer which has been deposited upon a substrate. Two ion beam sources are utilized. The first ion beam source is directed at a target material, such as molybdenum, for sputtering molybdenum onto the emitter material. The second ion beam source is utilized to etch the emitter material to produce cones or micro-tips. A low work function material, such as amorphous diamond, is then deposited over the micro-tips.

18 Claims, 13 Drawing Sheets

U.S. PATENT DOCUMENTS 4,687,938 8/1987 Tamura et al. .
4,710,765 12/1987 Ohkoshi et al. .
4,721,885 1/1988 Brodie .
4,728,851 3/1988 Lambe .
4,822,466 4/1989 Rabalais et al. .
4,835,438 5/1989 Baptist et al. .
4,851,254 7/1989 Yamamoto et al. .
4,855,636 8/1989 Busta et al. .
4,857,161 8/1989 Borel et al. .
4,857,799 8/1989 Spindt et al. .
4,874,981 10/1989 Spindt .
4,882,659 11/1989 Gloudemans .
4,899,081 2/1990 Kishino et al. .
4,908,539 3/1990 Meyer .
4,923,421 5/1990 Brodie et al. .
4,933,108 6/1990 Soredal .
4,940,916 7/1990 Borel et al. .
4,964,946 10/1990 Gray et al. .
4,987,007 1/1991 Wagal et al. .
4,990,766 2/1991 Simms et al. .
5,015,912 5/1991 Spindt et al. .
5,019,003 5/1991 Chason .
5,036,247 7/1991 Watanabe et al. .
5,038,070 8/1991 Bardai et al. .
5,054,047 10/1991 Shoulders .
5,055,744 10/1991 Tsuruoka .
5,063,323 11/1991 Longo et al. .
5,063,327 11/1991 Brodie et al. .
5,064,396 11/1991 Spindt ..... 445/50
5,075,591 12/1991 Holmberg .
5,089,292 2/1992 MaCaulay et al. .
5,089,742 2/1992 Kirkpatrick et al. .
5,090,932 2/1992 Dieumegard et al. .
5,098,737 3/1992 Collins et al. .
5,103,144 4/1992 Dunham .
5,103,145 4/1992 Doran .
5,117,267 5/1992 Kimoto et al. .
5,119,386 6/1992 Narusawa .
5,129,850 7/1992 Kane et al. .
5,138,237 8/1992 Kane et al. .
5,141,459 8/1992 Zimmerman .
5,141,460 8/1992 Jaskie et al. .
5,142,184 8/1992 Kane .
5,148,461 9/1992 Shoulders .
5,151,061 9/1992 Sandhu .
5,157,309 10/1992 Parker et al. .
5,162,704 11/1992 Kobori et al. .
5,180,951 1/1993 Dworsky et al. .
5,183,529 2/1993 Potter et al. .
5,186,670 2/1993 Doan et al. .
5,194,780 3/1993 Meyer .
5,199,917 4/1993 MacDonald et al. .
5,199,918 4/1993 Kumar .
5,202,571 4/1993 Hinabayashi et al. .
5,203,731 4/1993 Zimmerman .
5,204,581 4/1993 Andreadakis et al. .
5,210,430 5/1993 Taniguchi et al. .
5,212,426 5/1993 Kane .
5,228,877 7/1993 Allaway et al. .
5,228,878 7/1993 Komatsu .
5,229,331 7/1993 Doan et al. .
5,229,682 7/1993 Komatsu .
5,235,244 8/1993 Spindt .
5,243,252 9/1993 Kaneko et al. .
5,250,451 10/1993 Chouan .
5,252,833 10/1993 Kane et al. .
5,256,888 10/1993 Kane .
5,259,799 11/1993 Doan et al. .
5,275,967 1/1994 Taniguchi et al. .
5,277,638 1/1994 Lee .
5,278,475 1/1994 Jaskie et al. .
5,281,891 1/1994 Kaneko et al. .
5,283,500 2/1994 Kochanski .
5,285,129 2/1994 Takeda et al. .
5,312,514 5/1994 Kumar .
5,380,546 1/1995 Kirshnan et al. .
5,399,238 3/1995 Kumar .
5,401,676 3/1995 Lee ..... 445/50
5,468,169 11/1995 Kane et al. ..... 445/50

OTHER PUBLICATIONS

"Physical Properties of Thin Film Field Emission Cathodes," *J. Appl. Phys..*, vol. 47, 1976, p. 5248.

"Topography: Texturing Effects," *Handbook of Ion Beam Processing Technology*, No. 17, pp. 338–361.

"A Comparative Study of Deposition of Thin Films by Laser Induced PVD with Femtosecond and Nanosecond Laser Pulses," *SPIE*, vol. 1858 (1993), pp. 464–475.

"Amorphic Diamond Films Produced by a Laser Plasma Source," *Journal Appl. Physics*, vol. 67, No. 4, Feb. 15, 1990, pp. 2081–2087.

"Characterization of Laser Vaporization Plasmas Generated for the Deposition of Diamond–Like Carbon," *J. Appl. Phys.*, vol. 72, No. 9, Nov. 1, 1992, pp. 3966–3970.

"Cold Field Emission From CVD Diamond Films Observed in Emission Electron Microscopy," 1991.

"Deposition of Amorphous Carbon Films from Laser–Produced Plasmas," *Mat. Res. Soc. Svmp. Proc.*, vol. 38, (1985), pp. 326–335.

"Development of Nano–Crystaline Diamond–Based Field–Emission Displays," *Society of Information Display Conference Technical Digest*, 1994, pp. 43–45.

"Diamond–like Carbon Films Prepared with a Laser Ion Source," *Appl. Phys. Lett.*, vol. 53, No. 3, Jul. 18, 1988, pp. 187–188.

"Diamond Cold Cathode," *IEEE Electron Device Letters*, vol. 12, No. 8, (Aug. 1989) pp. 456–459.

"Emission Spectroscopy During Excimer Laser Albation of Graphite," *Appl. Phys. Letters*, vol. 57, No. 21, Nov. 19, 1990, pp. 2178–2180.

"Enhanced Cold–Cathode Emission Using Composite Resin–Carbon Coatings", Dept. of Electronic Eng. & Applied Physics, Aston Univ., Aston Triangle, Birmingham B4 7ET, UK, May 29, 1987.

"High Temperature Chemistry in Laser Plumes," John L. Margrave Research Symposium, Rice University, Apr. 28, 1994.

"Laser Ablation in Materials Processing: Fundamentals and Applications," *Mat. Res. Soc. Symp. Proc.*, vol. 285, (Dec. 1, 1992), pp. 39–86.

"Laser Plasma Source of Amorphic Diamond," *Appl. Phys. Lett.*, vol. 54, No. 3, Jan. 16, 1989, pp. 216–218.

"Optical Characterization of Thin Film Laser Deposition Processes," *SPIE*, vol. 1594, *Process Module Metrology, Control, and Clustering* (1991), pp. 411–417.

"Optical Emission Diagnostics of Laser–Induced Plasma for Diamond–Like Film Deposition," *Appl. Phys.*, vol. 52A, 1991, pp. 328–334.

"Optical Observation of Plumes Formed at Laser Ablation of Carbon Materials," *Appl. Surface Science*, vol. 79/80, 1994, pp. 141–145.

"Spatial Characteristics of Laser Pulsed Plasma Deposition of Thin Films," *SPIE*, vol. 1352, *Laser Surface Microprocessing* (1989), pp. 95–99.

"The Bonding of Protective Films of Amorphic Diamond to Titanium," *J. Appl. Phys.*, vol. 71, No. 7, Apr. 1, 1992, pp. 3260–3265.

"Thermochemistry of Materials by Laser Vaporization Mass Spectrometry: 2. Graphite," *High Temperatures–High Pressures*, vol. 20, 1988, pp. 73–89.

"Angular Characteristics of the Radiation by Ultra Relativistic Electrons in Thick Diamond Single Crystals," *Sov. Tech. Phys. Lett.*, vol. 11, No. 11, Nov. 1985, pp. 574–575.

"Diamond Cold Cathodes: Applications of Diamond Films and Related Materials," Elsevier Science Publishers BN, 1991, pp. 309–310.

"Electron Field Emission from Amorphic Diamond Thin Films," *6th International Vacuum Microelectronics Conference Technical Digest*, 1993, pp. 162–163.

"Electron Field Emission from Broad–Area Electrodes," *Applied Physics* A 28, 1982, pp. 1–24.

"Emission Properties of Spindt–Type Cold Cathodes with Different Emission Cone Material", *IEEE Transactions on Electron Devices*, vol. 38, No. 10, Oct. 1991.

"Enhanced Cold–Cathode Emission Using Composite Resin–Carbon Coatings," Dept. of Electronic Eng. & Applied Phiscs, Aston Univ., Aston Triangle, Birmingham B4 7ET, UK, May 29, 1987.

"Field Emission Displays Based on Diamond Thin Films," *Society of Information Display Conference Technical Digest*, 1993, pp. 1009–1010.

"Microstructure of Amorphic Diamond Films."

"Recent Development on 'Microtips' Display at LETI," *Technical Digest of IUMC 91*, Nagahama 1991, pp. 6–9.

"Sealed Vacuum Devices: Microchips Fluorescent Display," *3rd International Vacuum Microelectronics Conference*, Monterrey, U.S.A., Jul. 1990.

"Thin–Film Diamond," *The Texas Journal of Science*, vol. 41, No. 4, 1989, pp. 343–358.

"Use of Diamond Thin Films for Low Cost field Emissions Displays," *7th International Vacuum Microelectronics Conference Technical Digest*, 1994, pp. 229–232.

"The Field Emissions Display: A New Flat Panel Technology," CH–3071–8/91/0000–0012 501.00, 1991 IEEE.

"Current Display Research—A Survey," Zenith Radio Corporation, Ch. 5.1, pp. 64–58.

FIG. 5A
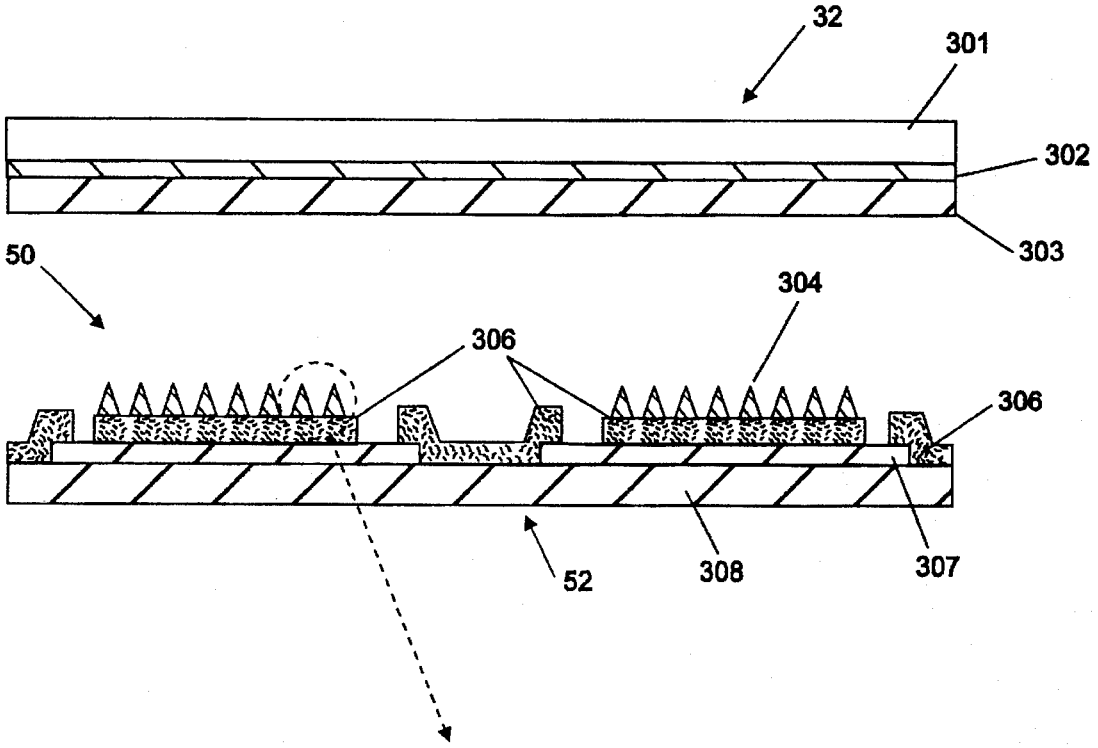
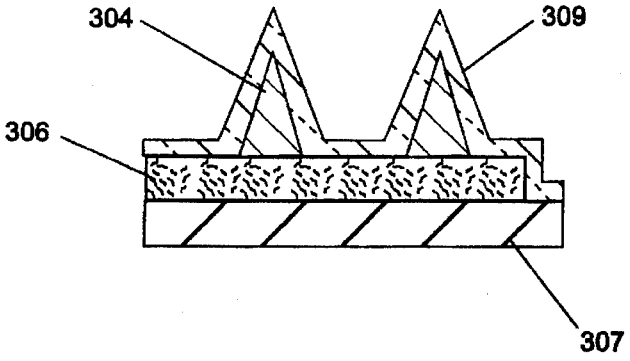
FIG. 5B

FIG. 6A
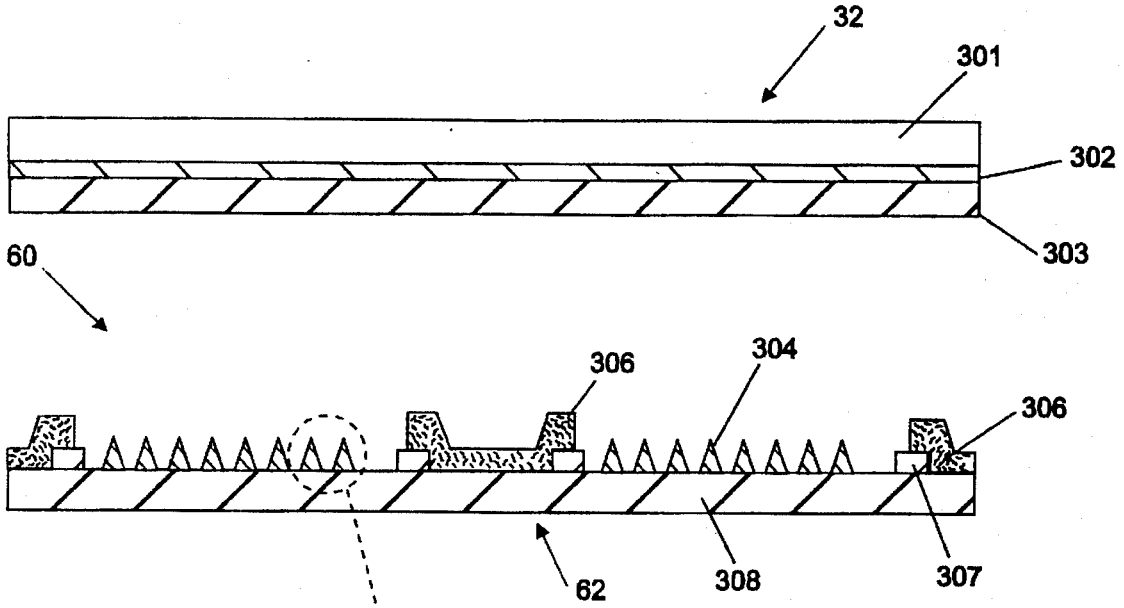
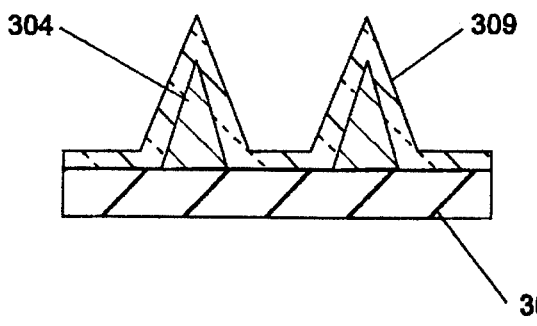
FIG.6B

FIG. 8A
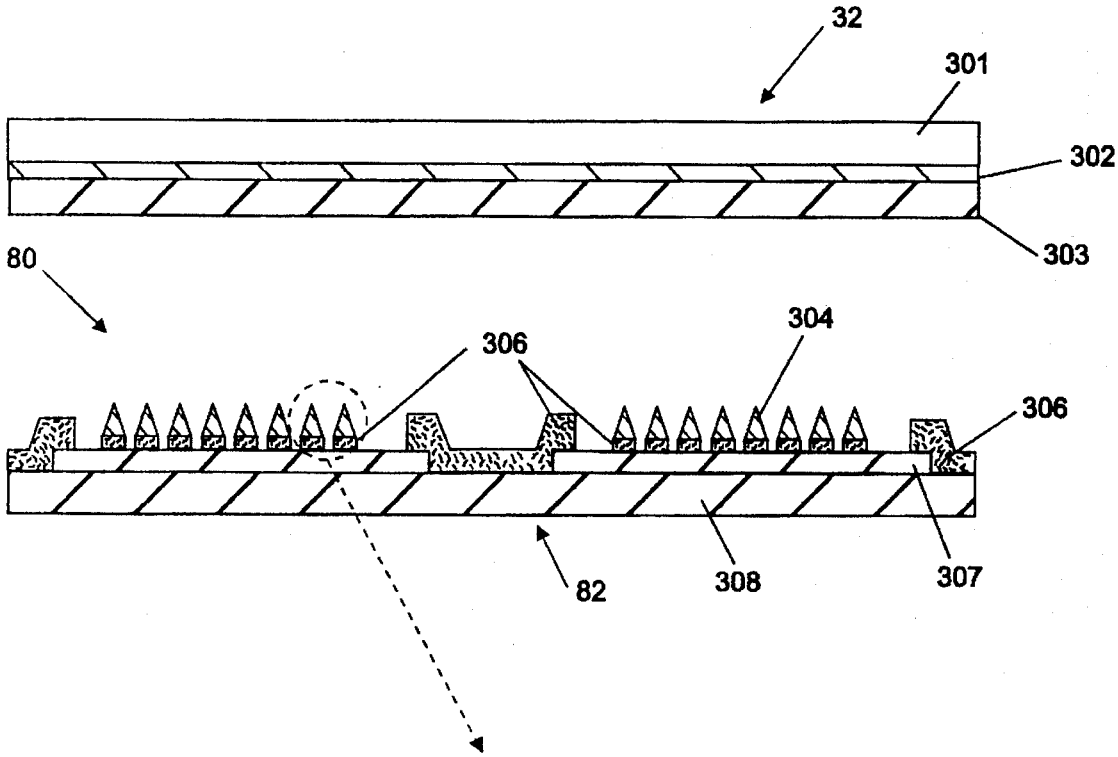
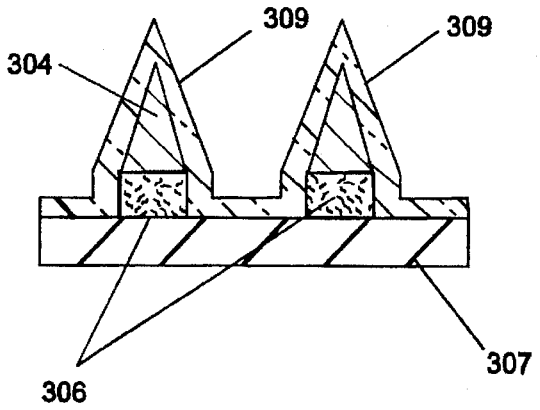
FIG. 8B

FIG. 9A
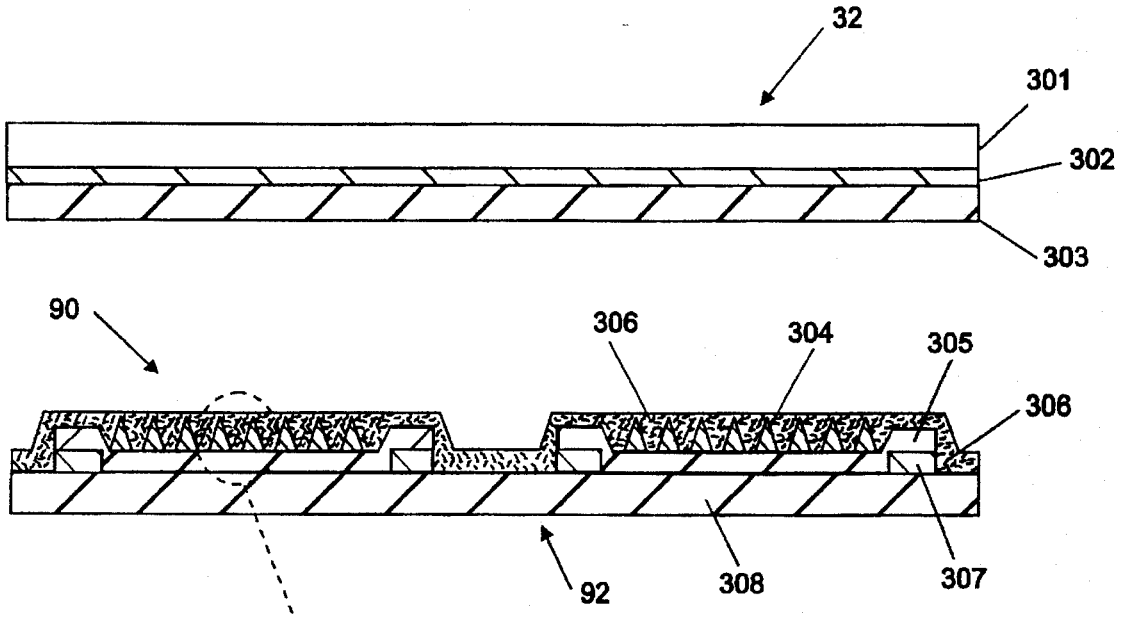
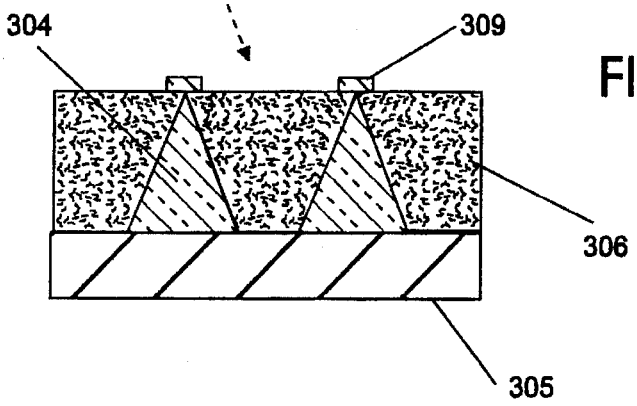
FIG. 9B

FIG. 10A
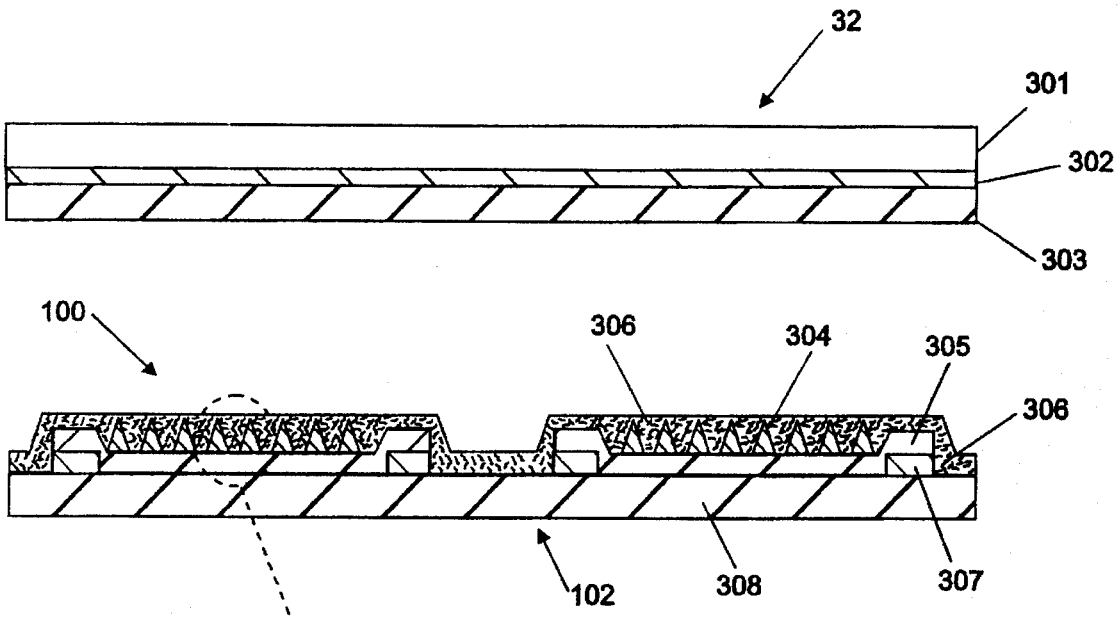
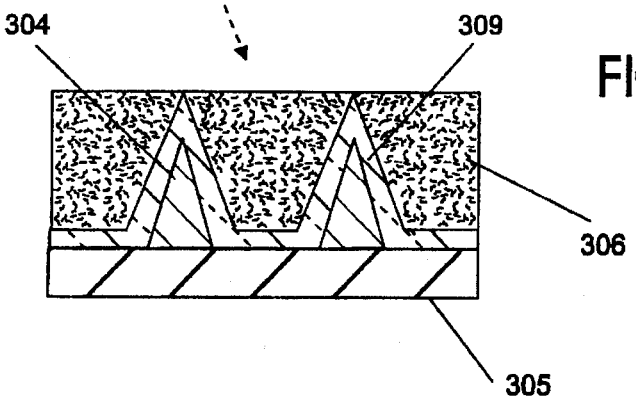
FIG. 10B

METHOD OF MAKING A FIELD EMISSION ELECTRON SOURCE WITH RANDOM MICRO-TIP STRUCTURES

CROSS-REFERENCE TO RELATED APPLICATION

This application for patent is related to the following application for patent filed concurrently herewith:

PRETREATMENT PROCESS FOR A SURFACE TEXTURING PROCESS, Ser. No. 08/427,462.

TECHNICAL FIELD OF THE INVENTION

The present invention relates in general to field emission devices, and more particularly, to a method of producing field emission devices having random micro-tip structures using ion beam sputtering and etching.

BACKGROUND OF THE INVENTION

Electrons emitted from field emission sources have been found useful in flat panel displays and vacuum microelectronics applications. Electron field emission is most easily obtained from sharply pointed needles, cones, or tips. U.S. Pat. No. 3,789,471 to Spindt, et al. and U.S. Pat. No. 5,141,460 to Jaskie, et al., which are hereby incorporated by reference herein, both disclose methods of making such micro-tips through lithography methods. However, such lithography methods require extensive fabrication facilities to finely tailor the emitter into a conical shape. Furthermore, with such fabrication methods, it is difficult to build a very dense field emitter, since the cone size is limited by the lithographic equipment. Furthermore. lithography is made even more difficult when the substrate area on which the microtips are to be constructed is of a large area, as is required by flat panel display type applications.

U.S. Pat. No. 5,199,918 to Kumar further discusses the disadvantages of the use of lithography for creating a field emitter device. U.S. Pat. No. 5,199,918 is hereby incorporated by reference herein. This patent teaches a method of fabricating a field emitter device by coating a substrate with a diamond film having negative electron affinity and a top surface with spikes and valleys, depositing a conductive metal on the diamond film, and etching the metal to expose portions of the spikes without exposing the valleys, thereby forming diamond emission tips which protrude above the conductive metal. One disadvantage of this method of fabricating field emitter tips is that the height and structure of the tips is limited by the crystalline structure of the diamond thin film deposited on the substrate.

Thus, what is needed in the art is a method of making a field emitter device that does not require the use of lithography and that is not limited to the crystalline structures provided by a diamond thin film.

SUMMARY OF THE INVENTION

The foregoing need is satisfied by the present invention, which discloses a system and method for fabricating a field emitter device by first providing a substrate for deposition of an emitter material, such as copper, and then sputtering a seed material, such as molybdenum, onto a surface of the emitter material and then etching the emitter material, which has been sputtered with the seed material. The sputtering of the seed material is performed by bombarding a target material with an ion beam originating from a Kaufman ion source. Etching of the emitter material to form cones or micro-tips is performed through the use of a second ion beam originating from a second Kaufman ion source.

A mass spectrometer is utilized to monitor the sputtering and etching processes for a predetermined amount of material, such as a resistive material (silicon), which may be deposited underneath the emitter material. Upon detection of this predetermined amount through the use of the mass spectrometer, the sputtering and etching processes can be terminated.

The result of the foregoing is production of micro-tips or cones on which a low work function material, such as amorphous diamond, is deposited. This field emitter device is then utilized in the production of a flat panel display or some other field emission microelectronic device.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWING

For a more complete understanding of the present invention, and the advantages thereof, reference is now made to the following descriptions taken in conjunction with the accompanying drawings, in which:

FIGS. 3A–10B and 12A–13B illustrate alternative structures of a field emitter device fabricated in accordance with the present invention.

DETAILED DESCRIPTION OF A PREFERRED EMBODIMENT OF THE INVENTION

Figure 1:
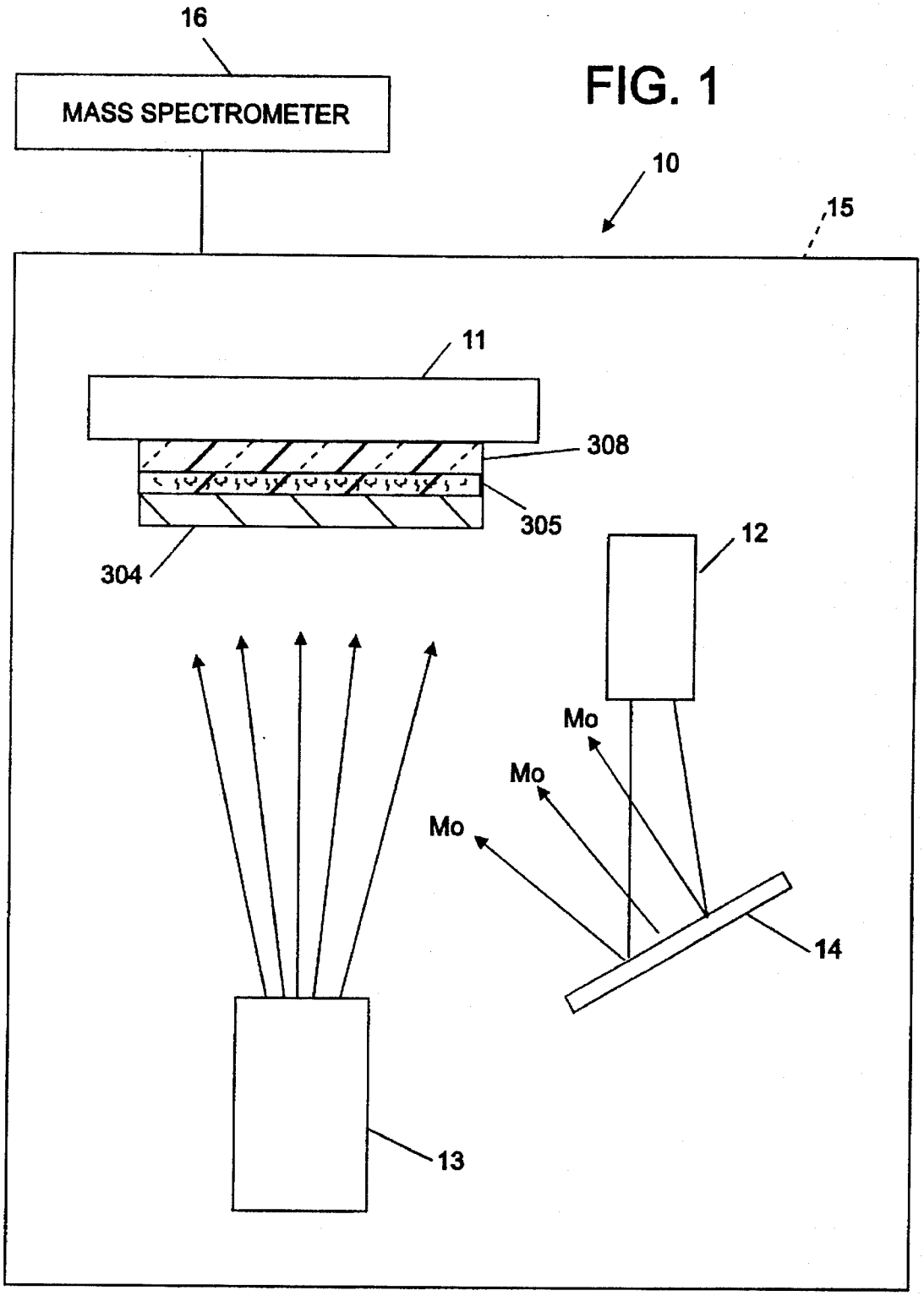
FIG. 1 illustrates an apparatus in accordance with a preferred embodiment of the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Refer now to the drawings wherein depicted elements are not necessarily shown to scale and wherein like or similar elements are designated by the same reference numeral through the several views.

Referring first to FIG. 1, there is illustrated dual ion beam system 10 in accordance with a preferred embodiment of the present invention. The ion beams produced by Kaufman ion source 13 (manufactured by Ion Tech, Inc., model no. MPS-3000FC) are utilized to etch material 304, while Kaufman ion source 12 is utilized to sputter seed material onto material 304. Evacuated chamber 15 (alternatively chamber 15 may be filled with a particular gas) may be utilized to enclose system 10.

Referring to FIGS. 1 and 2A–2D, glass substrate 308 is first cleaned. Glass substrate 308 may be first soaked in CHEMCREST™ detergent for 20 minutes at room temperature, then rinsed with de-ionized water for 10 minutes, and then dried by dry nitrogen gas. Next, depending upon the particular structure desired, a layer of 700 angstroms of chromium (Cr) is optionally deposited upon glass substrate 308. Next, resistive layer 305 is deposited using electron beam evaporation, sputtering or a CVD (chemical vapor deposition) process. Resistive layer 305 may be 5,000 angstroms (0.5 μm) of amorphous silicon (a-Si). Thereafter, a 3 μm (micrometer) copper (Cu) film is deposited upon layer 305, preferably utilizing electron beam evaporation. This entire structure, which will eventually comprise the cathode of a flat panel display, as further discussed below, is then loaded into system 10 and coupled to heater 11. Since the formation of the cones, or micro-tips, is a temperature-dependent process, heater 11 is used to assist in controlling the entire process.

Ion source 13 is utilized to etch away portions of material 304, while ion source 12 is utilized to sputter a seed material, which is preferably molybdenum (Mo), onto material 304. Ion source 13 is preferably operated with a beam energy of 800 volts and a beam current of 80 milliamps, while ion source 12 is preferably operated with a beam energy of 800 volts and a beam current of 50 milliamps. The molybdenum seed material is sputtered onto material 304 by the bombardment of molybdenum target 14 with an ion beam from ion source 12.

Figure 2A:
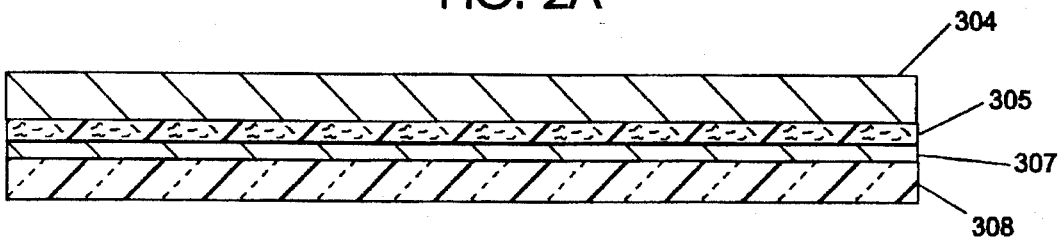
FIGS. 2A–2D illustrate a formation of micro-tips in accordance with the present invention.
Figure 2B:
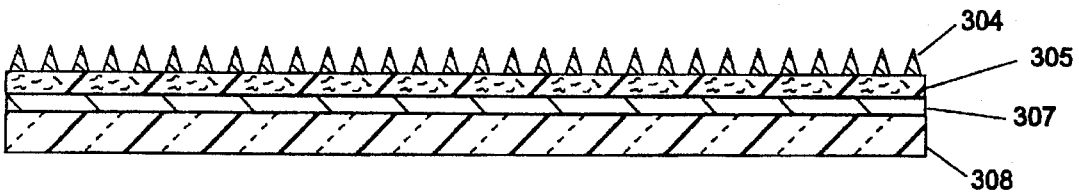

The result of this process implemented within dual ion beam system 10 is that portions of material 304 are etched away, resulting in cones, or micro-tips, as illustrated in FIG. 2B. Please refer to *Cone Formation as a Result of Whisker Growth on Ion Bombarded Metal Surfaces*, G. K. Wehner, J. Vac. Sci. Technol. A3(4), pp. 1821–1834 (1985) and *Cone Formation on Metal Targets During Sputtering*, G. K. Wehner, J. Appl. Phys., Vol. 42, No. 3, pp. 1145–1149 (Mar. 1, 1971), which are hereby incorporated by reference herein, which teach that such a cone structure may be produced by using one ion source for etching the material after it has been seeded with a material, such as molybdenum.

In the present invention, two ion beam sources 12 and 13 are utilized in conjunction, and preferably, though not necessarily, simultaneously. Ion beam source 13 etches away material 304 while ion beam source 12 sputters a seed material from target 14 to deposit on the surface of material 304. Note that source 12 and target 14 can be replaced with other deposition equipment, such as RF (radio frequency) sputtering or evaporation.

The structure, density and height of tips 304 are very sensitive to the ratio of the etching rate and the deposition rate of the seed material. At optimized conditions, the etching rate for Cu is 8 angstroms per second and the deposition rate for Mo is 0.2 angstroms per second. These conditions are achieved at the above noted 800 volts beam voltage and 50 milliamp beam current for source 12, and 80 milliamp beam current for source 13. Very small amounts of seed material can give rise to seed cone formation in material 304. In the case of Mo seed atoms on Cu, for producing cones, the ratio of Mo atoms arriving at material 304 can be as low as one seed atom per 500 sputtered Cu target atoms. In other words, the ratio of the deposition rate to the etching rate can be as low as 1/500.

Utilizing the dual ion system 10 of the present invention, this ratio of the deposition rate to the etching rate can be precisely controlled, which is not as easily implemented when only one ion source is utilized. Control of this process is implemented with the assistance of mass spectrometer 16, which is utilized to monitor the etching process. Once mass spectrometer 16 detects a preselected amount of resistive material 305, the etching process may be terminated. For example, if resistive material 305 is amorphous silicon, then mass spectrometer 16 will monitor for a preselected amount of silicon. If a preselected amount of silicon is monitored, then the process may be terminated either manually or automatically. Please refer to U.S. patent application Ser. No. 08/320,626, assigned to a common assignee, which is hereby incorporated by reference herein, for a further discussion of such a process.

Note that material 304 may also be comprised of gold (Ag) or silver (Au), while molybdenum may be replaced by tungsten (W).

Figure 2C:
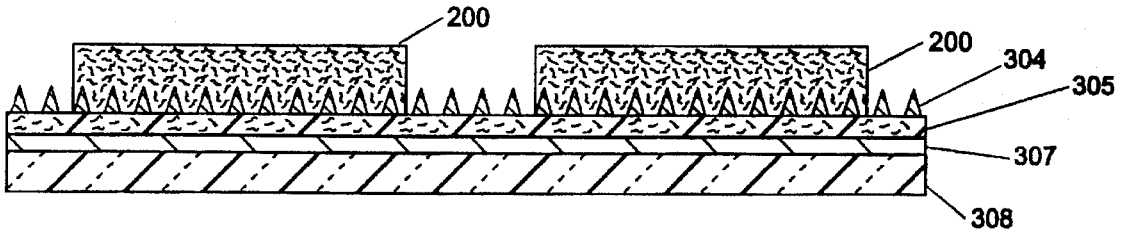
Figure 2D:
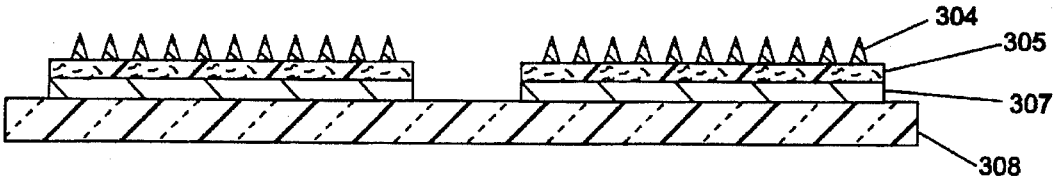
Figure 11:
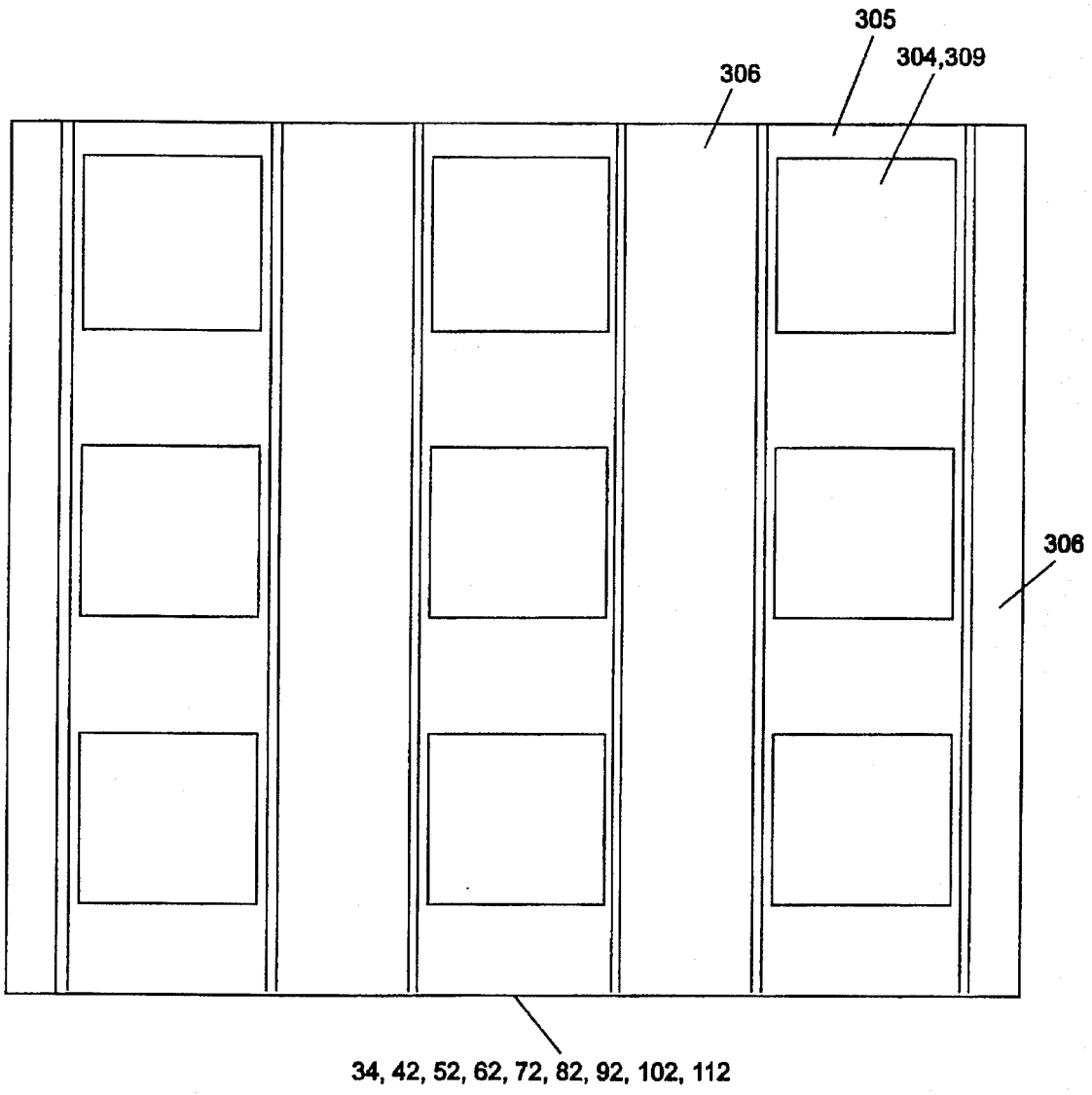
FIG. 11 illustrates a top view of a cathode fabricated in accordance with the present invention.

Referring to FIG. 2C, after formation of cones 304, photoresist coating 200 in a desired pattern may be deposited upon portions of the etched substrate so as to produce a desired pattern, such as illustrated in FIG. 11. Wet etching is then utilizing to remove the unwanted area resulting in the structure as illustrated in FIG. 2D and FIG. 11. Afterwards, as further illustrated in FIGS. 3A–10B, a thin layer of a low electric field cathode material having a low work function, may be deposited over micro-tips 304. A preferred film layer is comprised of 100 angstroms of amorphous diamond, which, as taught within U.S. Pat. No. 5,199,918 referenced above, is an ideal field emission material.

Figure 3A:
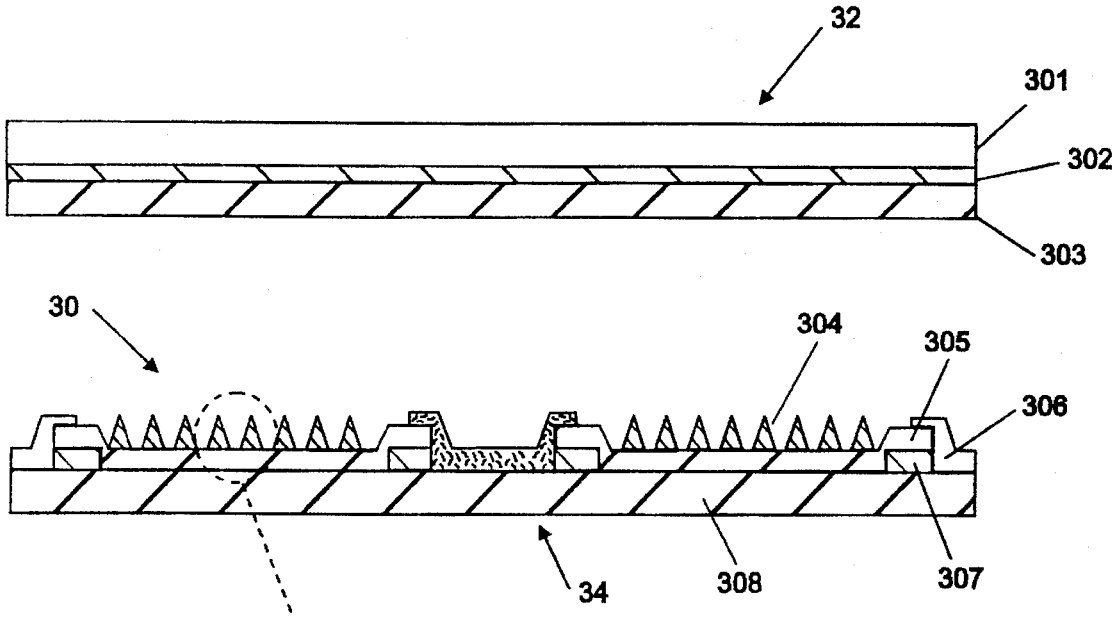

Referring to FIG. 3A, there is illustrated flat panel display 30 implemented from a combination of anode 32 and cathode 34. Note, one or more grid electrodes (not shown) may be implemented between anode 32 and cathode 34. Anode 32 is comprised of glass substrate 301 with an indium-tin oxide layer (ITO) 302 deposited thereon. ITO layer 302 is utilized to assist in the application of a field potential between anode 32 and cathode 34 in a sufficient amount to produce emission of electrons from micro-tip 304. Layer 302 may be deposited in strips so that "pixels" can be individually addressed within display 30 (see FIG. 11). Deposited on layer 302 is phosphor layer 303, which emits photons upon receipt of a bombardment of electrons emitted from micro-tips 304.

Cathode 34 is produced utilizing the process discussed with respect to FIGS. 1–2D. In FIG. 3A, micro-tips 304 are randomly distributed on the surface of resistive layer 305. They are connected electrically via resistive layer 305 to chrome lines 307. By applying a threshold voltage between ITO 302 and chrome lines 307, electrons are emitted from tips 304 uniformly.

Figure 3B:
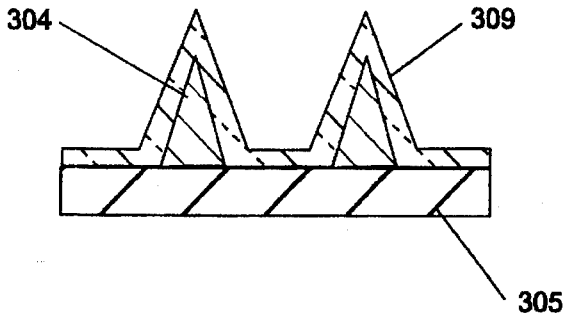

As illustrated in FIG. 3B, tips 304 are coated with amorphous diamond 309, or other materials, such as carbon, molybdenum, tungsten, transition metal (Ti, Zr, Hf, V, Nb, and Ta) carbides, AlN, and thin layer of $SiO_2$. Resistive layer 305 is preferably amorphous silicon of 5,000 angstroms. Material 306 is preferably a silicon dioxide ($SiO_2$) layer of 1 μm and is used to cover conductive layer 307 in order to prevent unwanted emissions from the edge of the lines.

Figure 4A:
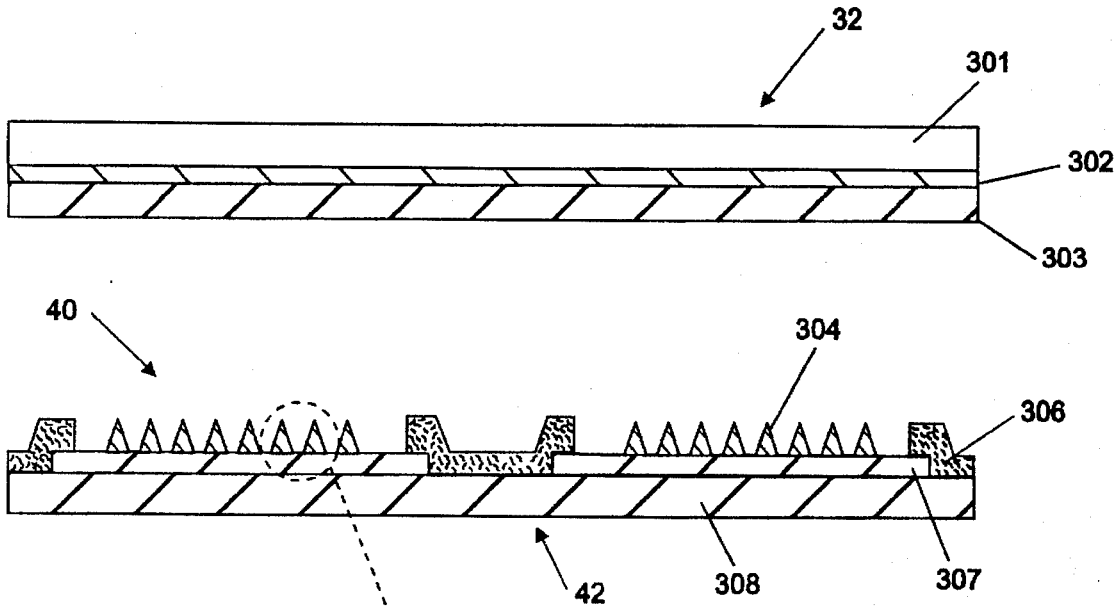
Figure 4B:
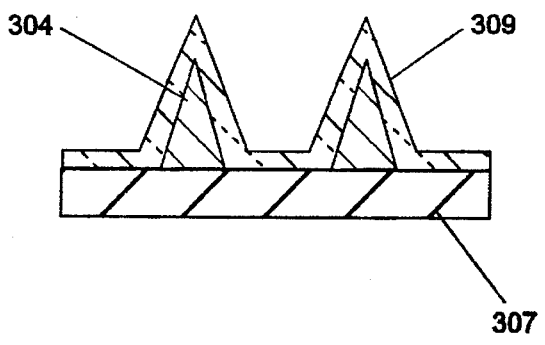

Cathode 42 illustrated in FIGS. 4A and 4B is similar to cathode 34 except that resistive layer 305 has been excluded, while metal layer 307 is deposited completely underneath micro-tips 304. Cathode 42 within display 40 may be manufactured utilizing system 10.

Referring to FIGS. 5A and 5B, display 50 utilizes cathode 52, which adds silicon dioxide layer 306 underneath micro-tips 304 and on top of metal layer 307. The resistances to the emitters are determined by layer 309 of amorphous diamond on the vertical wall of layer 306. The thicker the layer 306, the larger the resistance.

Display 60 illustrated in FIGS. 6A and 6B utilizes cathode 62 where micro-tips 304 lie directly on top of glass substrate 308. In this structure, cathode coating 309, preferably amorphous diamond, is utilized as the cathode coating and the resistive layer.

Figure 7A:
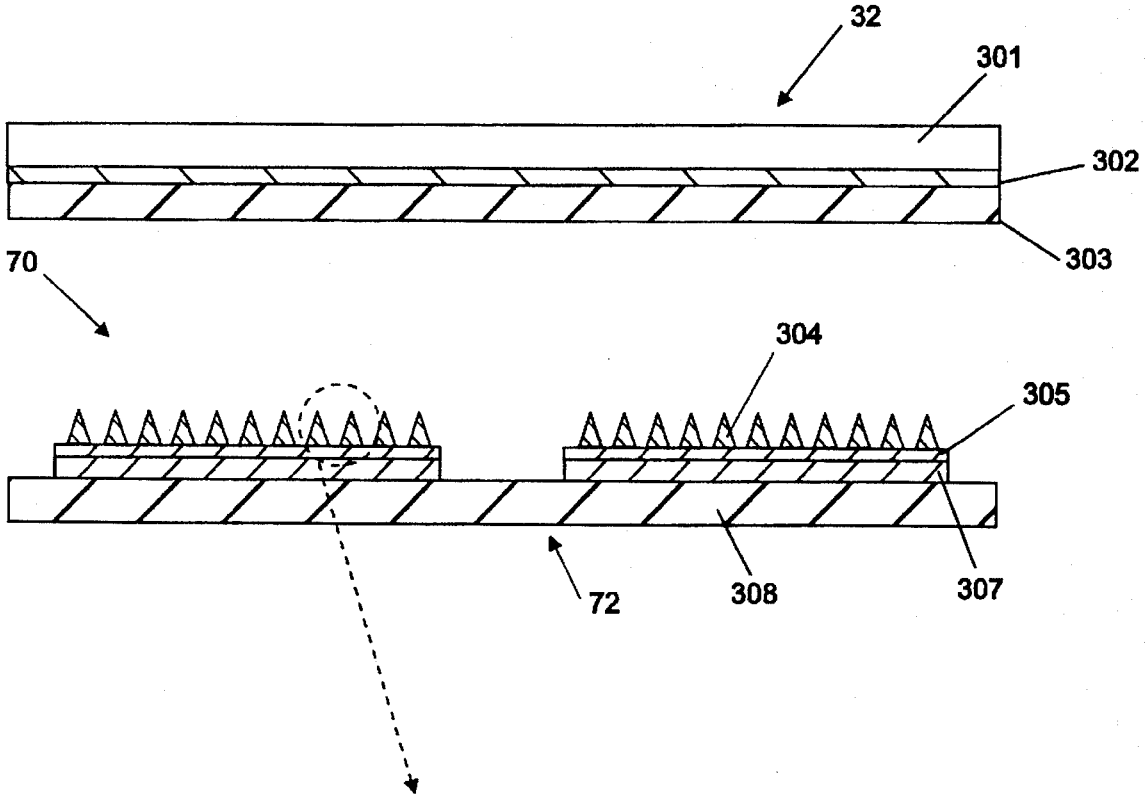
Figure 7B:
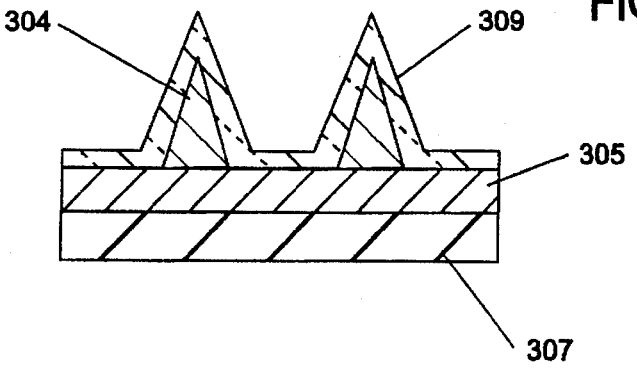

Display 70 illustrated in FIGS. 7A and 7B utilizes cathode 72 wherein micro-tips 304 are deposited on top of resistive layer 305, which is deposited on top of metal layer 307. The emitters 304 are connected electrically in parallel to the source so that they are independent of each other.

Cathode 82 of display 80 illustrated in FIGS. 8A and 8B is similar to cathode 52, except that emitters 304 are connected electrically to the source in series via a lateral resistive layer 306.

Cathode 92 illustrated in FIGS. 9A and 9B, and cathode 102 illustrated in FIGS. 10A and 10B are referred to as embedded micro-tip cathodes. In these structures there exists an interface between the conductive tips 304 and the insulating layer 306 around it. Under external electrical field, the insulating layer 306 charges up to some extent to create a huge internal field around the tips 304. Tips 304 emit electrons at high internal fields and low external fields.

In cathodes 92 and 102, micro-tips 304 are embedded in a layer of silicon dioxide 306. In FIG. 9B, there is illustrated that cathode material 309 is deposited on top of each tip 304 after deposition of layer 306, while layer 306 is deposited after layer 309 in FIG. 10B.

Figure 12A:
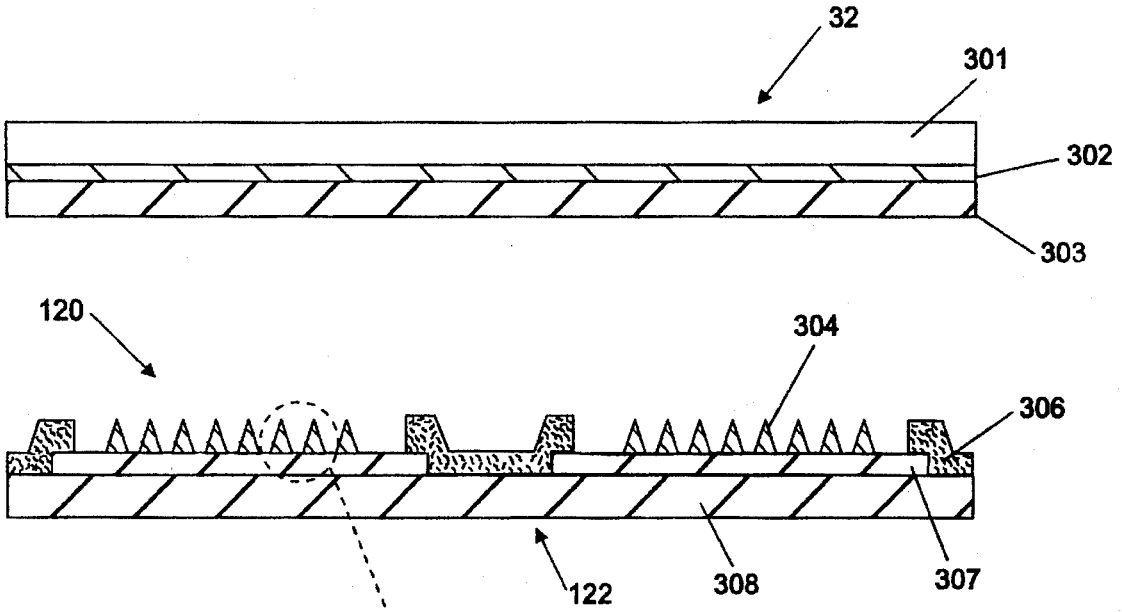
Figure 12B:
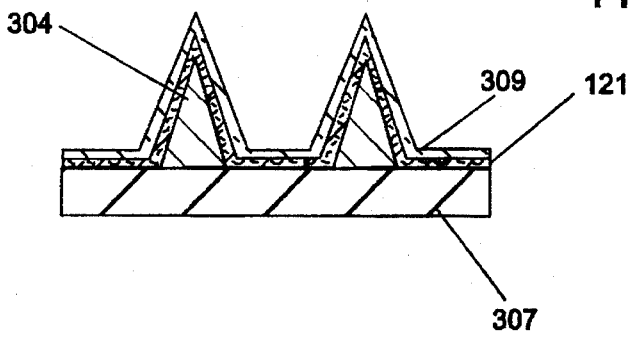

Cathode 120 illustrated in FIGS. 12A and 12B has tips 304 coated with resistive layer 121, such as amorphous silicon of 1000 angstroms. Then, cathode layer 309 is deposited on resistive layer 121. The emission current is limited by a resistance of the partial area underneath the emission area.

Figure 13A:
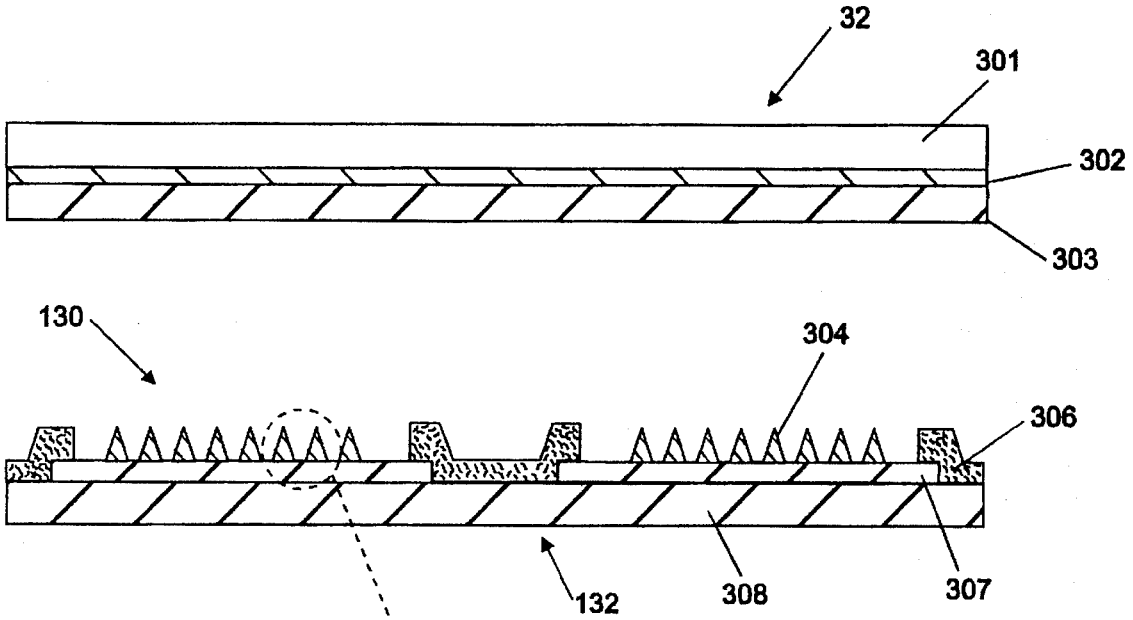
Figure 13B:
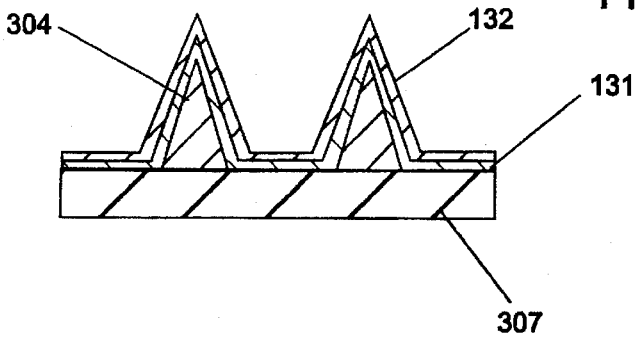

Cathode 130 illustrated in FIGS. 13A and 13B has tips 304 coated with carbon film 131 of 1000 angstroms. Then, carbide layer 132 of transition metal carbides, such as ZrC, HfC, TaC and TiC, is deposited on layer 131.

FIG. 11 illustrates a top view of any one of cathodes 34, 42, 52, 62, 72, 82, 92, 102, or 112. This view better illustrates how the various emitter sites, or pixels, may be formed into the cathode so that each site is separately addressable.

Although the present invention and its advantages have been described in detail, it should be understood that various changes, substitutions and alterations can be made herein without departing from the spirit and scope of the invention as defined by the appended claims.

What is claimed is:

1. A method of fabricating a field emitter device, said method comprising the steps of:

providing a substrate;

depositing an emitter material on said substrate;

sputtering a seed material onto a surface of said emitter material by bombarding a target material with a first ion beam; and etching said emitter material, which has been sputtered with said seed material, with a second ion beam, wherein said substrate includes a layer of a second material on which said emitter material has been deposited by said depositing step, further comprising the step of:

stopping said etching step upon detection of a predetermined amount of said second material.

2. The method as recited in claim 1, wherein said step of stopping said etching step upon detection of a predetermined amount of said second material further comprises the step of:

monitoring an electromagnetic spectrum originated at a location of said emitter material for said predetermined amount of said second material.

3. The method as recited in claim 1, wherein said second material is a resistive material.

4. The method as recited in claim 1, wherein said emitter material is a conductive material such as copper, gold, or silver.

5. The method as recited in claim 1, wherein said seed material and said target material is molybdenum or tungsten.

6. The method as recited in claim 1, wherein a ratio of said sputtering to said etching is at least 1/500.

7. The method as recited in claim 1, wherein said steps of sputtering and etching are performed substantially simultaneously.

8. The method as recited in claim 1, wherein said emitter material and said substrate are located in an evacuated chamber, and wherein a layer of low work function material is deposited on said emitter material upon conclusion of said steps of sputtering and etching.

9. The method as recited in claim 8, wherein said low work function material is amorphous diamond.

10. A method of fabricating a field emitter device, said method comprising the steps of:

providing a substrate;

depositing an emitter material on said substrate;

sputtering a seed material onto a surface of said emitter material by bombarding a target material with a first ion beam;

etching said emitter material, which has been sputtered with said seed material, with a second ion beam;

depositing a layer of insulating material on said etched emitter material so that tips of cones of said emitter material protrude from said layer of insulating material; and depositing a low work function material on said tips of said cones of said emitter material.

11. A method of fabricating a field emitter device, said method comprising the steps of:

providing the substrate depositing an emitter material on said substrate;

sputtering a seed material onto a surface of said emitter material by bombarding a target material with a first ion beam;

etching said emitter material, which has been sputtered with said seed material, with a second ion beam; depositing a layer of low work function material on said etched emitter material; and depositing a layer of insulating material on said layer of low work function material.

12. A system for fabricating randomly located micro-tipped structures of a first material, said system comprising:

means for depositing an emitter material on a substrate;

means for sputtering a seed material onto a surface of said emitter material by bombarding a target of said seed material with a first ion beam originating from a first ion beam source; and means for etching said emitter material, which has been sputtered with said seed material, with a second ion beam originating from a second ion beam source, wherein said substrate includes a layer of a second material on which said emitter material has been deposited, said system further comprising:

means for detecting a predetermined amount of said second material.

13. The system as recited in claim 12, wherein said means for detecting a predetermined amount of said second material further comprises:

a mass spectrometer for monitoring an electromagnetic spectrum originated at a location of said emitter material for said predetermined amount of said second material.

14. The system as recited in claim 12, wherein said emitter material is a conductive material such as copper, gold, or silver.

15. The system as recited in claim 12, wherein said seed material has a higher melting point that said emitter material.

16. The system as recited in claim 12, wherein a ratio of said sputtering to said etching is at least 1/500.

17. The system as recited in claim 12, wherein said sputtering and etching are performed substantially simultaneously.

18. The system as recited in claim 12, wherein said emitter material and said first and second ion beam sources are located in an evacuated chamber, further comprising:

means for depositing a layer of low work function material on said emitter material.

* * * * *